US006708355B1

(12) United States Patent
Wang et al.

(10) Patent No.: US 6,708,355 B1
(45) Date of Patent: Mar. 23, 2004

(54) COLLAPSIBLE OUTDOOR PILLOW STRUCTURE

(75) Inventors: Kung-Han Wang, Taipei Hsien (TW); Chin-Sheng Huang, Taipei Hsien (TW)

(73) Assignee: SEDA Chemical Products Co., Ltd., Taipei Hsien (TW)

( * ) Notice: Subject to any disclaimer, the term of this patent is extended or adjusted under 35 U.S.C. 154(b) by 0 days.

(21) Appl. No.: 10/267,584

(22) Filed: Oct. 10, 2002

(51) Int. Cl.[7] ..... A47G 9/10
(52) U.S. Cl. ..... 5/644; 5/640; 5/645; 5/490
(58) Field of Search ..... 5/636, 640, 644, 5/645, 490, 491, 711, 655.3; 383/4

(56) References Cited

U.S. PATENT DOCUMENTS

| | | | | | |
|---|---|---|---|---|---|
| 918,391 | A | * | 4/1909 | Taarud | 5/644 |
| 2,612,645 | A | * | 10/1952 | Boland | 5/644 |
| 3,204,678 | A | * | 9/1965 | Worcester | 383/3 |
| 3,312,987 | A | * | 4/1967 | Emery | 5/644 |
| 4,277,859 | A | * | 7/1981 | Seaman | 5/639 |
| 4,768,247 | A | * | 9/1988 | Beier | 5/640 |
| 5,228,158 | A | * | 7/1993 | Park | 5/636 |
| 5,802,644 | A | * | 9/1998 | Scheurer | 5/640 |
| 6,009,577 | A | * | 1/2000 | Day | 5/636 |
| 6,047,425 | A | * | 4/2000 | Khazaal | 5/644 |
| 6,131,219 | A | * | 10/2000 | Roberts | 5/644 |
| 6,487,737 | B1 | * | 12/2002 | Futagami | 5/644 |
| 6,532,611 | B1 | * | 3/2003 | Day | 5/636 |

* cited by examiner

*Primary Examiner*—Michael F. Trettel
(74) *Attorney, Agent, or Firm*—Bacon & Thomas

(57) ABSTRACT

The invention is to provide a collapsible outdoor pillow structure, the said structure consisting of an inflatable bag and resilient body affixed onto its surface, wherein air can be admitted into and released from the said inflatable bag such that following the release of air from the said bag, a fastening component at one end of a pillow cloth casing bottom surface is attached to a fastening component along one side of a folding sack and the said pillow is rolled up in the said folding sack; after the fastening component along the rear surface of one side of the said folding sack is attached to another fastening component along the front surface at the other side, cords at the two ends of the folding sack are pulled to achieve the objective of conveniently carrying the said folding sack and the pillow outdoors.

4 Claims, 3 Drawing Sheets

COLLAPSIBLE OUTDOOR PILLOW STRUCTURE

BACKGROUND OF THE INVENTION

1) Field of the Invention

The invention herein relates to a collapsible outdoor pillow structure.

2) Description of the Prior Art

Due to the modern-age progress, technological development, employment, and busy lifestyles in contemporary society as well as operating computers, playing electronic games, or prolonged desk work along with great competitive pressures that leave little time for exercise, office workers are especially susceptible to physical injuries and the associated painful discomfort due to remaining in the same posture for extended periods or improper movement, which results in head and spinal constriction that leads to other combined symptoms.

Walking or jogging are usually the only means of invigorating the nervous system. Although such activity exercises tendons and bones a sufficient degree, they cannot provide physical relief and easily results in additional fatigue. As a result, a supportive pillow has been considered to cushion the head while a person is sleeping, with the structure of the pillow ergonomically designed to relieve stress between the head and the spine.

While the various ergonomic pillows now available on the market typically meet the requirements of relieving stress between the human head and the spine, and thereby alleviate the head-to-spine pressure of users, since the said ergonomic pillows are of permanent physical spatiality and weight, they are limited to bedroom use and cannot be convenient carried outside. If brought outdoors, the user finds that them impractical and an object that draws attention. Thus, when a user accustomed to utilizing a said ergonomic pillow encounters a situation (such as a business trip, camping, or traveling, etc.) that involves spending a night away from home, since the said ergonomic pillow is incapable of facilitating portability and the user cannot enjoy the feeling of relief provided by the ergonomic pillow in their residential bedroom, this is troublesome to the user.

As such, if the designer and manufacturer of the said pillow can design a pillow that is not only ergonomically designed but also lightweight and, furthermore, conveniently foldable and easy to carry around such that the user can enjoy relief of stress between the head and the spine when a night is spent away from home, such a product will be a great forward stride in the industry welcomed by users.

SUMMARY OF THE INVENTION

In view of the fact that existent ergonomic pillows are capable of relieving pressure, but the said pillows have physical spatiality and weight limitations that precludes user utilization away from home and which substantially detracts the function of the said ergonomic pillow, resulting in difficulties, inconvenience, and other shortcomings when the user has to spend the night away from home, the applicant conducted extensive research and experimentation based on many years of experience gained while engaged in the production of such products which culminated in the successful development and design of a simple arrangement, collapsible outdoor pillow structure.

The objective of the invention herein is to provide a collapsible outdoor pillow structure, the said structure consisting of an inflatable bag and resilient body affixed onto its surface, wherein air can be admitted into and released from the said inflatable bag such that following the release of air from the said bag, a fastening component at one end of a pillow cloth casing bottom surface is attached to a fastening component along one side of a folding sack and the said pillow is rolled up in the said folding sack; after the fastening component along the rear surface of one side of the said folding sack is attached to another fastening component along the front surface at the other side, cords at the two ends of the folding sack are pulled to achieve the objective of conveniently carrying the said folding sack and the pillow outdoors.

Another objective of the invention herein is to provide a collapsible outdoor pillow structure, wherein a plurality of strip members of are fixed to the corresponding interior surfaces of the said inflatable bag and another strip member is situated between every two said strip members, and following the inflation of the said inflatable bag, arcuate contours of different height as well as recessed sections are formed in the curved surface along the two antipodal exterior surfaces of the said inflatable bag and the resilient body such that when the user rests against the surface of the said resilient body, the head is accommodated by the said recessed sections, thereby properly supporting and equally distributing the pressure of the head and the neck to achieve a natural reposing posture; additionally, the pillow structure of the invention herein is not only lightweight and, furthermore, conveniently foldable and easily carriable outdoors such when the user spends a night away from home, the present invention is capable of relieving stress between the head and neck, while also increasing the market competitiveness of the said pillow.

The above and other objects, features and advantages of the present invention will become apparent from the following detailed description taken with the accompanying drawings.

DETAILED DESCRIPTION OF THE INVENTION

The invention herein was designed to address the user inconveniences, difficulties, and other drawbacks caused by existent ergonomic pillow structures that cannot be taken outdoors by users due to their physical spatiality and weight limitations.

Referring to FIG. 1, FIG. 2, FIG. 3 and FIG. 4, the most preferred embodiment of the collapsible outdoor pillow structure of the invention herein, the said pillow 1 is comprised of a resilient body 10, the said resilient body 10 fabricated of a compressible, temperature-sensitive, and viscid elastic material (such as visco-elastic polyurethane foam or polyurethane (PU) foam), with the said elastic material consisting of a corporeality that produces strain as pressure is applied such that original elasticity is gradually restored following pressure dispersal.

Figure 1:
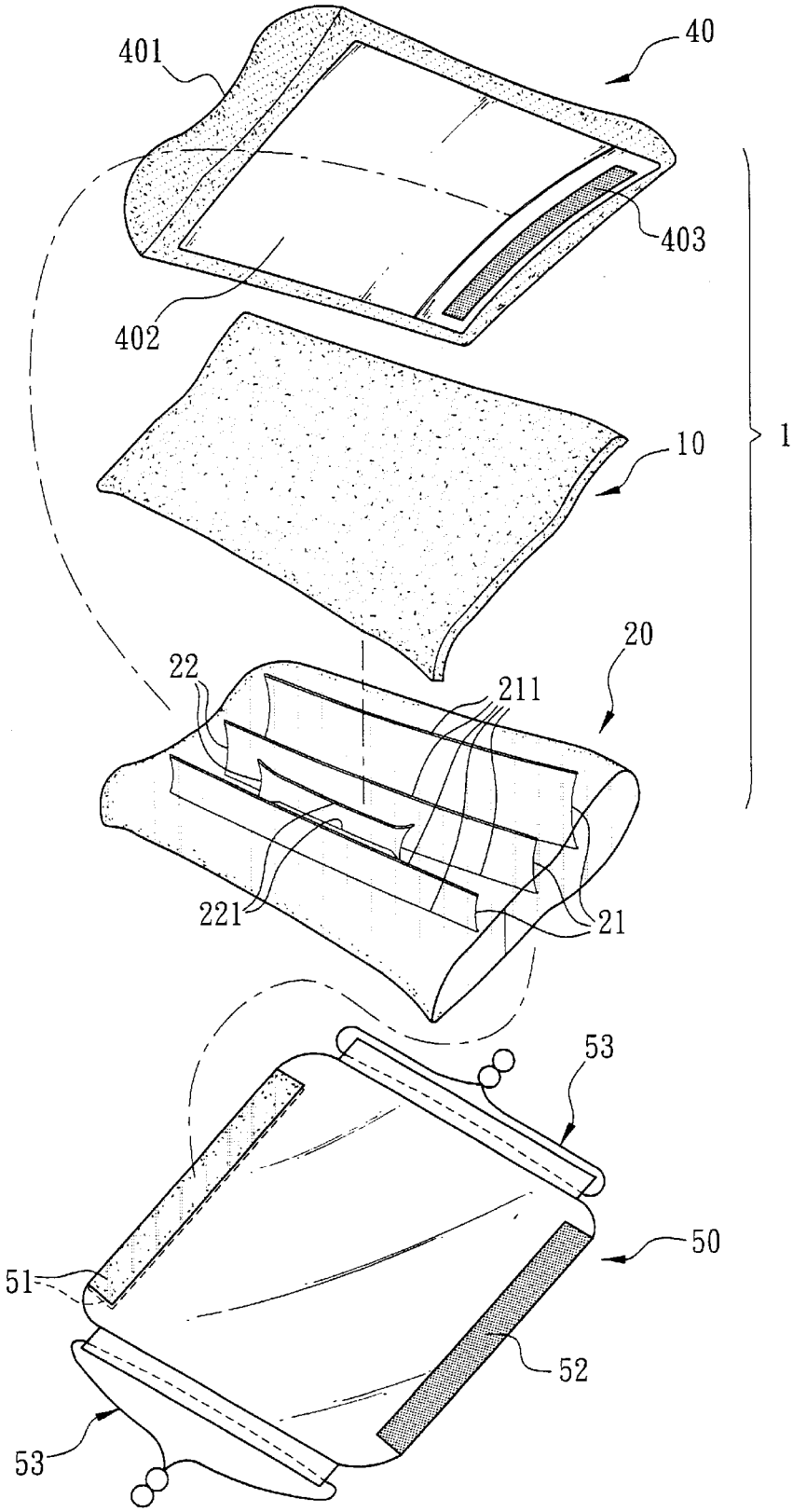
FIG. 1 is an exploded drawing of the invention herein.
Figure 2:
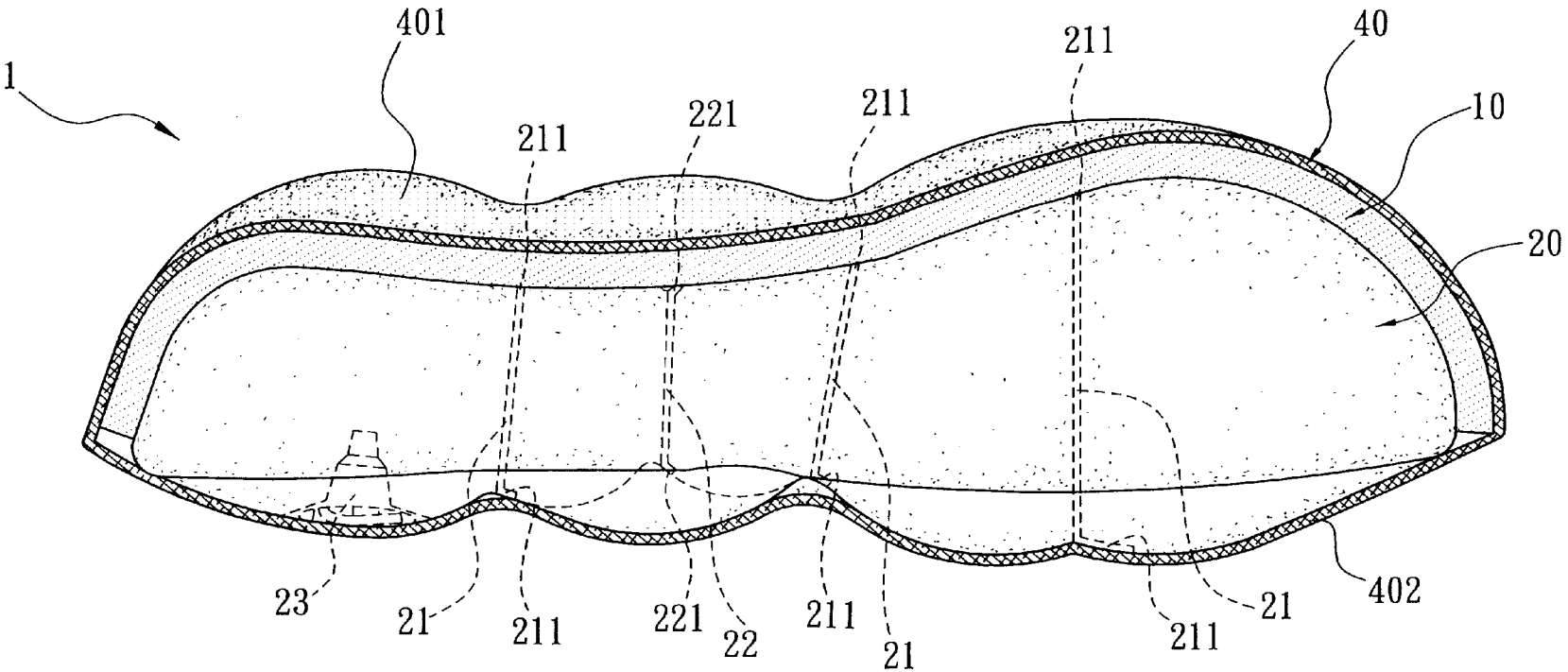
FIG. 2 is a cross-sectional drawing of the invention herein.

In the said embodiment, one surface of an inflatable bag 20 is affixed to the bottom surface of the said resilient body 10, the attachment achieved through a means of adhesion (as shown in FIG. 1), the adhesive substance consisting of a strong glue (but not limited to the said adhesive substance and although persons skilled in the field of technology can easily produce modifications or improvised equivalents, all shall be remain included among the following features of the present invention) and, furthermore, the surface area of the said inflatable bag 20 is slightly smaller than the surface area of the said resilient body 10 such that after the said inflatable bag 20 is inflated by admitting air into its interior, the outer edges of the said resilient body 10 are even with and, furthermore, covered by the inflatable bag 20 once it is filled with air (as shown in FIG. 2).

In the said embodiment, a plurality of strip members 21 of varying width are disposed horizontally at certain intervals apart inside the said inflatable bag 20, with the two opposing sides 211 of each said strip Member 21 fixed to the corresponding interior surfaces of the said inflatable bag 20; furthermore, another strip member 22 is situated between every two strip members 21 and each said other strip member 22 has a length and a width that enables confluence with each said strip member 21, with the two opposing sides 221 of each said other strip member 22 fixed to the corresponding interior surfaces of the said inflatable bag 20 (as shown in FIG. 1 and FIG. 2) and, furthermore, an air nozzle 23 is disposed proximal to a comer on the other surface of the said inflatable bag 20, enabling the admission of the air into the inflatable bag 20 through the said air nozzle 23 and the inflation of the said inflatable bag 20 such that following the inflation of the said inflatable bag 20, the different width layouts of the said strip members 21, the widths of the said other strip members 22, as well as the opposing sides 211 and 221 of the said strip members 21 and the said other strip members 22 fixed to the corresponding interior surfaces of the said inflatable bag 20 form arcuate contours of different height as well as recessed sections in the said curved surface along the two antipodal exterior surfaces of the said inflatable bag 20, with the resilient body 10 assuming a profile that is identical to the arcuately contoured surfaces and recessed sections such that when the user rests against the surface of the said resilient body 10 (not shown in the drawings), the head is accommodated by the said recessed sections, thereby properly supporting and equally distributing the pressure of the head and the neck to achieve a natural reposing posture.

Additionally, due its design, the said air nozzle 23 is capable of controlling the volume of air admitted into the said inflatable bag 20 and thereby adjust the height and hardness of the said inflatable bag 20 to meet the requirements of any user.

In the said embodiment, a cloth casing 40 is externally sleeved over the said resilient body 10 and the said inflatable bag 20 (as shown in FIG. 1 and FIG. 2) to constitute the said pillow 1, wherein the surface 401 of the said cloth casing 40 is made from a material of superior tactility and perspiration absorbency (such as terry cloth) and its bottom surface 402 consists of a non-slip material, with the air nozzle 23 of the said inflatable bag 20 inserted through and exposed at the said bottom surface 402.

In the said embodiment, the said pillow 1 structure also includes a folding sack 50; when the said folding sack 50 is open, it is in a flat state (as shown in FIG. 1) with a fastening component 51 disposed along the front and the rear surfaces of one side, another fastening component 52 disposed along the opposite lateral front surface that is aligned with the said fastening component 51, and a cord 53 positioned at each of the remaining opposite ends of the structure in the flat state.

Figure 3:
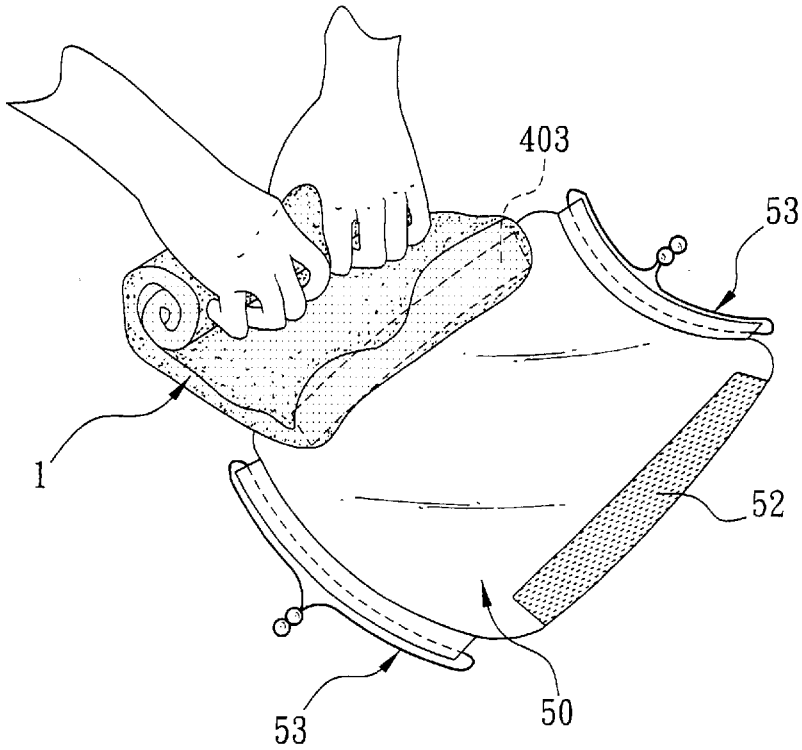
FIG. 3 is an isometric drawing of the invention herein (1).
Figure 4:
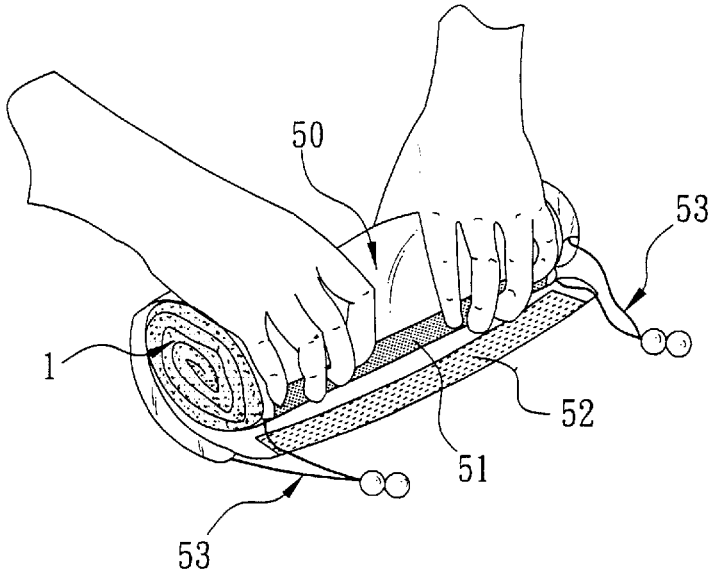
FIG. 4 is an isometric drawing of the invention herein (2).

To collapse the said pillow 1, air inside the said inflatable bag 20 is released through the said air nozzle 23, a fastening component 403 at one end of the pillow 1 cloth casing 40 bottom surface 402 is attached to the fastening component 51 along one side of the said folding sack 50 (as shown in FIG. 1 and FIG. 3); and the said folding sack 50 is rolled up from the said side (somewhat as a sushi is wrapped); after the fastening component 51 along the rear surface of one side of the said folding sack 50 is attached to the other fastening component 52 along the front surface at the other side (as shown in FIG. 4), the physical size of the said pillow is reduced and the said cords 53 at the two ends of the folding sack 50 are pulled to conveniently carry the said folding sack 50 and pillow 1 outdoors.

Given the said arrangement, the pillow 1 structure of the invention herein is not only lightweight and, furthermore, conveniently foldable and carriable outdoors, the volume of air admitted into the said inflatable bag 20 enables the adjustment of the height and hardness of the pillow 1 to meet the requirements of any user such that the head and neck of the user are properly supported and pressure is equally distributed, thereby affording head and neck comfort and the achievement of natural repose; as such, the pillow 1 of the invention herein is not only ergonomically shaped, but has numerous advantages in that it is lightweight, does not occupy excessive space, convenient to fold, and carriable outdoors, while also affording greater user acceptance and increasing the market competitiveness of the said pillow 1.

What is claimed is:

1. A collapsible outdoor pillow structure comprised of:

a resilient body fabricated of a viscid, elastic material;

an inflatable bag, one surface of which is fastened to a bottom surface of the said resilient body, with an air nozzle disposed on its other surface;

a plurality of strip members of varying width disposed horizontally at certain intervals apart inside said inflatable bag, each of said strip members having two opposing sides fixed to corresponding interior surfaces of said inflatable bag;

another strip member situated between every two said strip members, each said other strip member having a length and a width that enables coming together or meeting with each said strip member, each of said other strip members having two opposing sides fixed to corresponding interior surfaces of said inflatable bag;

following the inflation of said inflatable bag, the different width layouts of said strip members, the widths of said other strip members, as well as said opposing sides of said strip members and said other strip members fixed to the their respective corresponding interior surfaces of said inflatable bag form arcuate contours of different height as well as recessed sections in a curved surface along two antipodal exterior surfaces of the said inflatable bag.

2. A collapsible outdoor pillow structure as claimed in claim 1 in which the surface area of said inflatable bag is slightly smaller than the surface area of said resilient body such that after said inflatable bag is inflated by admitting air into its interior, the outer edges of said resilient body are even with and, furthermore, covered by said inflatable bag once it is filled with air.

3. A collapsible outdoor pillow structure as claimed in claim 1 in which said resilient body and said inflatable bag are enclosed in a cloth casing having a bottom surface and, furthermore, said air nozzle of said inflatable bag is inserted through and exposed at said bottom surface of said cloth casing.

4. A collapsible outdoor pillow structure as claimed in claim 3 in which said pillow structure also includes a folding sack having front and rear surfaces, which when open is in a flat state with a fastening component disposed along the front and the rear surfaces of one side, another fastening component disposed along an opposite lateral front surface that is aligned with said fastening component, and a cord positioned at each of remaining opposite ends of the structure in the flat state such that when folded, air inside said inflatable bag is released through said air nozzle, following which a fastening component at one end of said pillow cloth casing bottom surface is attached to said fastening component along one side of said folding sack and said pillow is rolled up in said folding sack; after the said fastening component along the rear surface of one side of said folding sack is attached to said other fastening component along the front surface at the opposite side, whereby each of said cords are pulled to conveniently carry said folding sack and said pillow outdoors.

* * * * *